US007404431B2

(12) United States Patent
Blejde et al.

(10) Patent No.: US 7,404,431 B2
(45) Date of Patent: Jul. 29, 2008

(54) PRODUCTION OF THIN STEEL STRIP

(75) Inventors: Walter N. Blejde, Brownsburg, IN (US); Rama Ballav Mahapatra, Indianapolis, IN (US)

(73) Assignee: Nucor Corporation, Charlotte, NC (US)

( * ) Notice: Subject to any disclaimer, the term of this patent is extended or adjusted under 35 U.S.C. 154(b) by 240 days.

(21) Appl. No.: 10/417,694

(22) Filed: Apr. 17, 2003

(65) Prior Publication Data

US 2004/0020631 A1 Feb. 5, 2004

Related U.S. Application Data

(60) Provisional application No. 60/385,783, filed on Jun. 4, 2002.

(51) Int. Cl.
*B22D 11/16* (2006.01)
*B22D 11/06* (2006.01)

(52) U.S. Cl. ..... 164/452; 164/480

(58) Field of Classification Search ..... 164/451, 164/452, 453, 454, 480
See application file for complete search history.

(56) References Cited

U.S. PATENT DOCUMENTS

| | | | | |
|---|---|---|---|---|
| 5,031,688 | A | 7/1991 | Burgo et al. | |
| 5,052,467 | A * | 10/1991 | Tanaka et al. | 164/452 |
| 5,462,109 | A | 10/1995 | Vincze et al. | |
| 5,488,988 | A | 2/1996 | Fukase et al. | |
| 5,520,243 | A | 5/1996 | Freeman et al. | |
| 6,092,586 | A | 7/2000 | Schonbeck | |
| 6,408,222 | B1 | 6/2002 | Kim et al. | |
| 6,474,403 | B1 | 11/2002 | Nikolovski et al. | |
| 6,575,225 | B1 * | 6/2003 | Hohenbichler et al. | 164/480 |
| 6,581,672 | B2 * | 6/2003 | Strezov et al. | 164/452 |
| 2002/0062942 | A1 | 5/2002 | Strezov et al. | |
| 2003/0196776 | A1 | 10/2003 | Strezov et al. | |

FOREIGN PATENT DOCUMENTS

| | | |
|---|---|---|
| EP | 0 684 098 A2 | 11/1995 |
| EP | 0 867 244 A1 | 9/1998 |
| JP | 60-49836 | 3/1985 |
| JP | 63-224846 | 9/1988 |
| JP | 2-52149 | 2/1990 |
| JP | 7-132349 | 5/1995 |
| JP | 2002143988 | 5/2002 |
| WO | WO 99/33595 | 7/1999 |

* cited by examiner

*Primary Examiner*—Kevin P Kerns
(74) *Attorney, Agent, or Firm*—Hahn Loeser & Parks LLP

(57) ABSTRACT

A method of controlling in a twin roll strip caster the thickness of as-cast strip by determining and operating at a target depth of the casting pool and a target speed of the casting rolls. The as-cast strip may be cast to a customer-specified thickness or may be subsequently rolled to a customer-specified thickness.

6 Claims, 4 Drawing Sheets

FIG. 2,

PRODUCTION OF THIN STEEL STRIP

RELATED APPLICATION

This application claims priority to, and the benefit of U.S. provisional patent application 60/385,783, filed Jun. 4, 2002.

BACKGROUND AND SUMMARY OF THE INVENTION

This invention relates to the production of thin steel strip in a strip caster.

In a twin roll caster, molten metal is introduced between a pair of counter-rotated horizontal casting rolls which are internally cooled so that metal shells solidify on the moving roll surfaces and are brought together at the nip between them to produce a solidified strip product delivered downwardly from the nip between the rolls. The term "nip" is used herein to refer to the general region at which the casting rolls are closest together. The molten metal may be poured from a ladle into a smaller vessel from which molten metal flows through a metal delivery nozzle located above the nip, forming a casting pool of molten metal supported on the casting surfaces of the rolls above the nip and extending along the length of the nip. This casting pool is usually confined between side plates or dams held in sliding engagement with end surfaces of the casting rolls to dam the two ends of the casting pool against outflow, although alternative means such as electromagnetic barriers have also been proposed. The casting of steel strip in twin roll casters of this kind is for example described in U.S. Pat. Nos. 5,184,668; 5,277,243; and 5,934,359.

When casting steel strip in a twin roll caster, the strip leaves the nip at very high temperatures of the order of 1400° C. and if exposed to air, the strip suffers very rapid scaling due to oxidation of the strip at such high temperatures.

It has therefore been proposed to shroud the newly cast strip within an enclosure containing a non-oxidizing atmosphere until its temperature has been reduced significantly, typically to a temperature of the order of 1200° C. or less so as to reduce scaling. One such proposal is described in U.S. Pat. No. 5,762,126 according to which the cast strip is passed through a sealed enclosure from which oxygen levels are reduced by initial oxidizing of the strip passing through the enclosure. Thereafter the oxygen content in the sealed enclosure is maintained at less than the surrounding atmosphere by continuing oxidizing of the strip passing through the enclosure and controlling the thickness of the scale on the strip emerging from the enclosure. The emerging strip may be reduced in thickness in an in-line rolling mill and then generally subjected to forced cooling, for example by water sprays, and the cooled strip is then coiled in a conventional coiler.

As more fully described in U.S. patent application Ser. No. 09/967163 and International Application PCT/AU01/01215, steel strip can be produced from molten steel of a given composition with any of a wide range of microstructures, and in turn a wide range of yield strengths, by continuously casting the strip and thereafter selectively cooling the strip to transform the strip from austenite to ferrite in a temperature range between 850° C. and 400° C. It is understood that the transformation range is within the range between 850° C. and 400° C. and not that entire temperature range. The precise transformation temperature range will vary with the chemistry of the steel composition and processing characteristics.

Specifically, from work carried out on low carbon steel, including low carbon steel that has been silicon/manganese killed or aluminum killed, it has been determined that selecting cooling rates in the range of 0.010° C. /sec to greater than 100° C. /sec, to transform the strip from austenite to ferrite in a temperature range between 850° C. and 400° C., can produce steel strip that has yield strengths that range from 200 MPa to 700 MPa or greater. By selection of an appropriate cooling rate it is possible to produce a microstructure which governs the yield strength selected from a group that includes microstructures that are (1) predominantly polygonal ferrite; (2) a mixture of polygonal ferrite and low temperature transformation products and (3) predominantly low temperature transformation products. The term "low temperature transformation products" includes Widmanstatten ferrite, acicular ferrite, bainite and martensite.

This development enables production of thin steel strip from molten steel of a given chemistry to meet differing customer-specified yield strength requirements by varying the conditions under which the as-cast strip is cooled through the austenite to ferrite transformation range.

As described in U.S. application Ser. No. 60/236390, it is also possible to change other process parameters in the strip casting process to produce strip meeting varying customer requirements from a given strip casting line.

By the present invention, the thickness of the as-cast strip is controlled by changing the depth of the casting pool. This enables the casting rolls to be operated at a generally constant heat flux, which permits maximum throughput without generating excessive temperatures at the casting surfaces while varying the strip thickness. Accordingly, a single-roll profile may be used for casting rolls with a substantially constant throughput to produce a broad range of different cast strip thicknesses. Also, with the present invention, a constant as-cast microstructure can be maintained in the cast strip, which can consistently and predictably be modified and controlled by the subsequent cooling regime to produce strip having customer-specified properties. Further, increased flexibility in varying the thickness of the as-cast strip is provided that enables the subsequent reduction in the in-line rolling mill to be selected primarily for optimum control of strip surface roughness.

According to the invention there is provided a method of casting cast steel strip from a casting pool of molten steel using the casting surfaces of a twin roll caster to produce strip of differing thicknesses in the as-cast condition, comprising:

(a) determining for each desired thicknesses of the as-cast strip, a target casting speed which will avoid over-heating of the casting roll surfaces;

(b) determining from each target casting speed a target casting pool depth to produce a cast strip of the desired thickness when the twin roll caster is operated at the target casting speed; and (c) operating the caster to cast strip based on the determined target casting speed and the determined target depth to produce cast strip generally of the desired thickness.

The method may be performed with a single, twin, or multi-roll roll caster. The as-cast strip may have differing thicknesses, which may be customer-specified, or may be reduced, as by for example in-line rolling, to a desired customer-specified thickness.

In determining the target casting speed and the target casting pool depth, predetermined characteristics of the casting rolls of the roll casters such as the diameter of the casting rolls and heat flux rate through the casting surfaces may be factors to be considered. The casting rolls may include copper or copper alloy sleeves defining the casting surfaces of the rolls. In this case, the casting roll characteristics may include the diameter of the rolls and the thickness of the sleeves, which affect the relation between the casting speed and the casting surface temperature for a particular heat flux.

If these physical characteristics of the casting rolls remain essentially the same, then the caster can be operated at substantially the same production throughput rate, hence it is possible to calculate the target casting speed (u) for a given cast thickness, and then the target casting pool depth is varied to control the as-cast thickness of the strip, i.e., the target casting pool depth is decreased to decrease the as-cast thickness of the strip.

The casting pool depth is measured from the nip of the casting roll, where the strip departs from the casting surfaces of the casting rolls, vertically to the level of the casting pool The target pool depth may be determined from the target casting speed in accordance with the following equation:

$$R*\sin^{-1}(h/R)=u*d^2/(k^2) \quad \text{(Eq. 1)}$$

where, h=pool depth (mm),

R=casting roll radius (mm), d=half strip thickness (mm).

k=roll k-factor ($mm/min^{0.5}$), u=casting speed (mm/min).

The roll k-factor is determined empirically by determining solidification rates in accordance with the formula $$d'=k\sqrt{t}$$

where d' is the half strip thickness, and t is time.

The invention also provides a method of producing a steel strip to customer-specified thickness comprising operating a twin roll caster in the manner defined above either to produce as-cast strip of differing customer-specified thicknesses or to produce as-cast strip of a thickness greater than the customer-specified thickness and then rolling the cast strip in line with the caster to reduce its thickness to the customer-specified thickness.

The as-cast thickness may be greater than the customer-specified thickness by an amount in the range 0% to 30%. Typically the reduction may be of the order of 15%.

The present invention further provides a method of producing steel strip to a customer-specified thickness by casting strip from a casting pool of molten steel using a pair of casting rolls of a twin roll caster and optionally rolling the as-cast strip to reduce its thickness, comprising:

(a) setting a target as-cast strip thickness based on the customer-specified thickness;

(b) determining a target casting speed based on the selected target as-cast thickness and casting roll characteristics while avoiding over heating of the casting roll surfaces;

(c) determining from the target casting speed a target pool depth to produce a strip of the target thickness when the casting rolls are operated to cast the strip at the target casting speed;

(d) operating the twin roll caster to cast strip based on the target casting speed and the target pool depth; and (e) optionally in-line rolling the as-cast strip delivered from the caster to reduce its thickness to the customer-specified thickness.

The certain factor for setting the desired as-cast strip thickness may be chosen such that in-line rolling achieves a surface roughness target. The desired as-cast strip thickness may be the customer-specified thickness.

BRIEF DESCRIPTION OF THE DRAWINGS

In order that the invention may be more fully explained one illustrative manner of putting it into effect will be described with reference to the accompanying drawings in which.

DETAILED DESCRIPTION OF THE DRAWINGS

Figure 1:
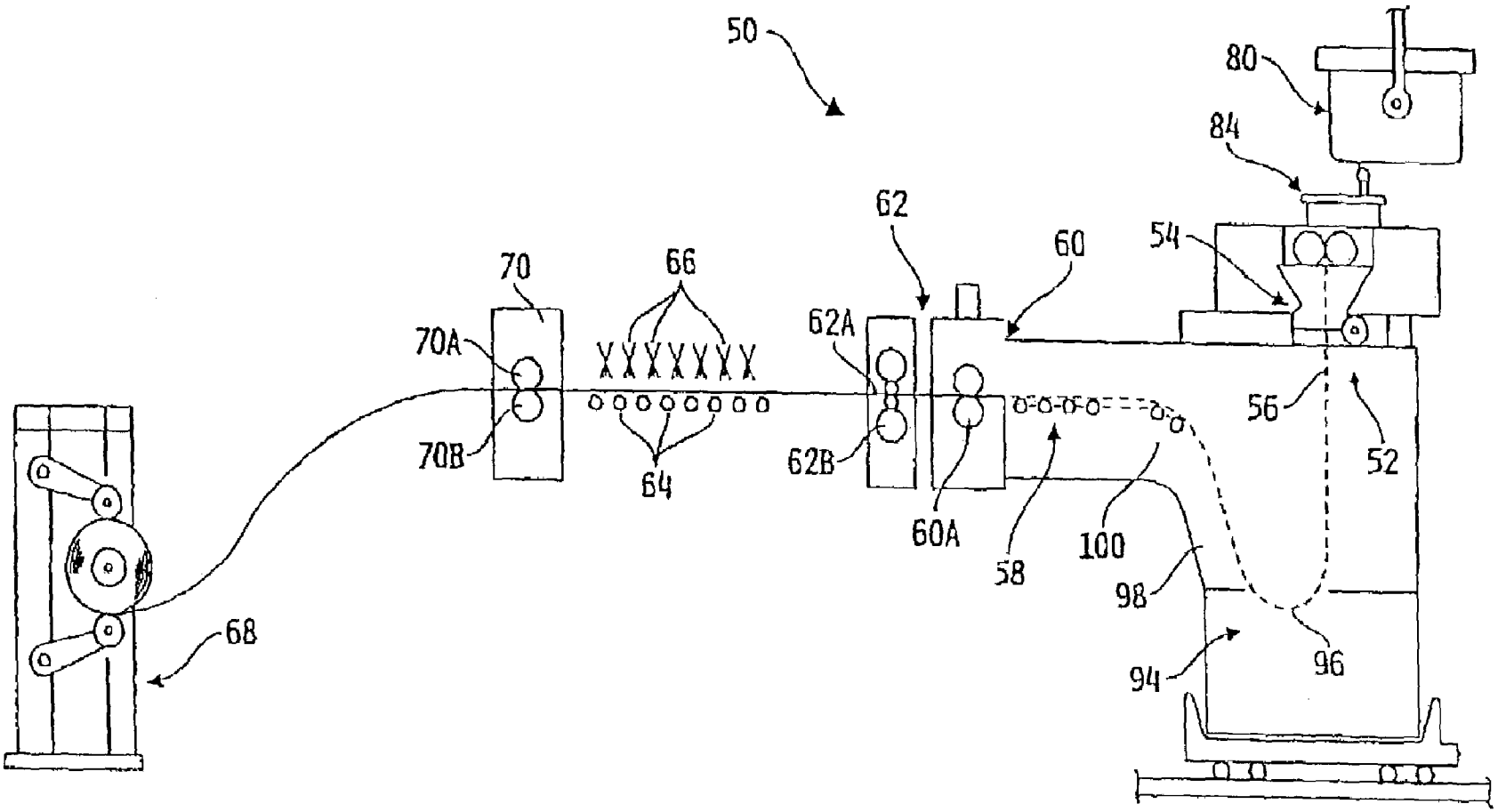
FIG. 1 illustrates a continuous strip casting production line by which steel strip can be produced.
Figure 2:
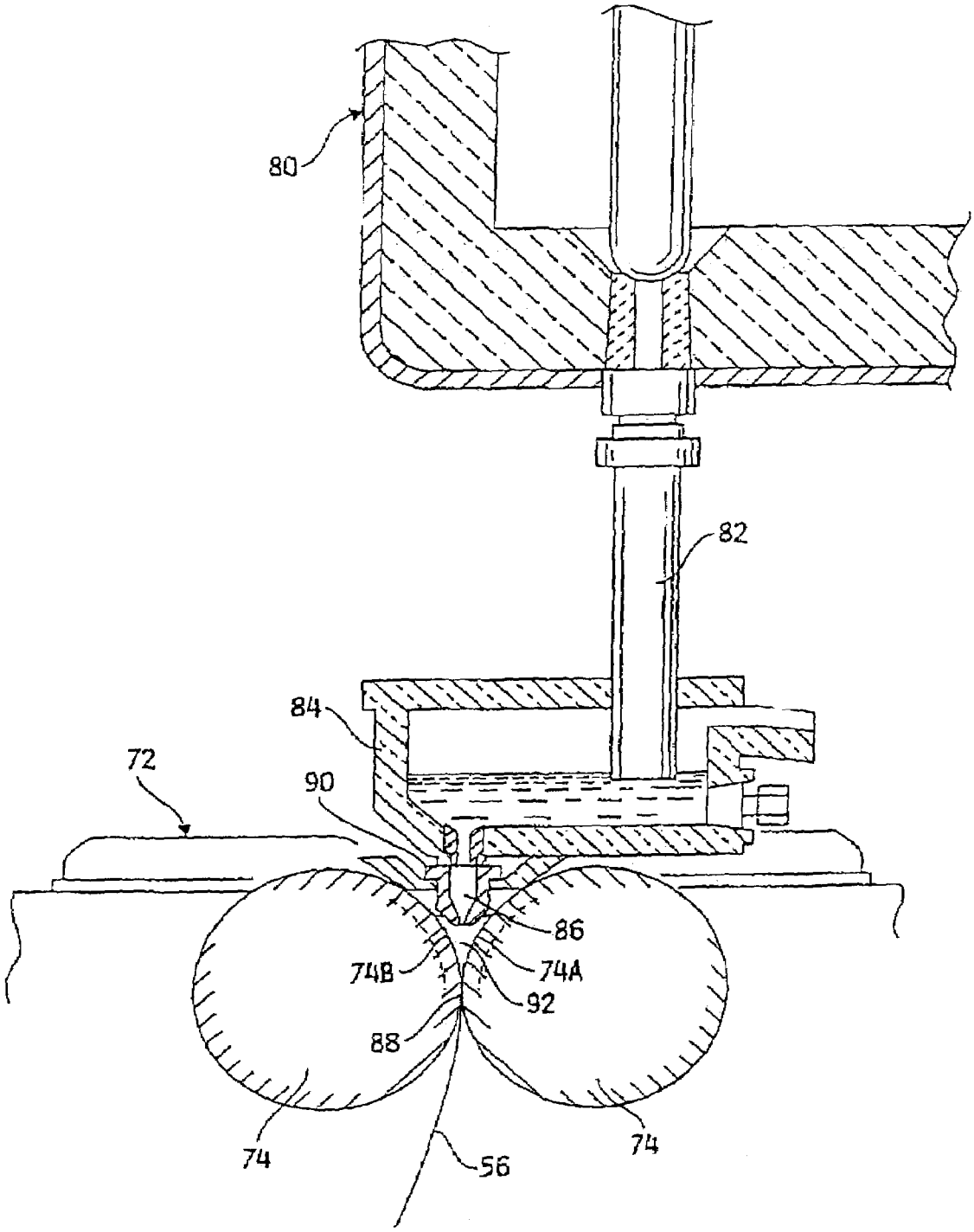
FIG. 2 illustrates major components of a twin roll strip caster incorporated in the production line.

Referring to FIGS. 1 and 2, a continuous strip steel casting apparatus/process 50 is illustrated as successive parts of a production line whereby steel strip can be produced. This production line includes a twin roll caster denoted generally as 54 which produces as-cast steel strip 56 that passes in a transit path 52 across a guide table 58 to a pinch roll stand 60 comprising pinch rolls 60A. The thickness of the as-cast strip is considered as the strip thickness at the exit from the twin roll caster, but the thickness of the cast strip is generally measured on exit of the strip from the pinch rolls by an x-ray gage recognizing that the thickness of the strip can be reduced by the pinch rolls. This measured thickness on exit from the pinch roll is generally reported as the as-cast thickness of the strip.

Immediately after exiting the pinch roll stand 60, the cast strip optionally passes into a hot rolling mill 62, in which the strip is hot rolled to reduce its thickness to a customer-specified thickness. The hot rolling mill 62 comprises a pair of reduction rolls 62A and backing rolls 62B. The rolled strip passes onto a run-out table 64 on which the strip may be force cooled by water jets 66 and through a pinch roll stand 70 comprising a pair of pinch rolls 70A and 70B, and thence to a coiler 68.

Referring now to FIG. 2, roll caster 54 comprises a main machine frame 72 which supports a pair of parallel positioned casting rolls 74 having casting surfaces 74A and 74B. Molten metal is supplied during a casting operation from a ladle (not shown) to a tundish 80, through a refractory shroud 82 to a distributor 84 and thence through a metal delivery nozzle 86 into the nip 88 between the casting rolls 74. Molten metal thus delivered to the nip 88 forms a casting pool 92 supported on the casting roll surfaces 74A above the nip 88. This casting pool 92 is confined at the ends of the rolls by a pair of side closure dams or plates 90, which are positioned at the ends of the rolls by a pair of thrusters (not shown) comprising hydraulic cylinder units connected to side plate holders. It will be appreciated that biasing force provided by the hydraulic cylinders may be alternatively provided by, for example, springs or a servo mechanism. The upper surface of casting pool 92 (generally referred to as the "meniscus" level) may rise above the lower end of the delivery nozzle 86 so that the lower end of the delivery nozzle 86 is immersed within this casting pool 92.

Casting rolls 74 are internally water cooled so that shells solidify on moving roll surfaces 74A and are brought together at the nip 88 between rolls 74 to produce the solidified strip 56 which is delivered downwardly from the nip 88. The twin roll caster 54 may be of the kind which is illustrated and described in some detail in U.S. Pat. Nos. 5,184,668 and 5,277,243 or 5,488,988, the disclosures of which are each expressly incorporated herein by reference.

Figure 3:
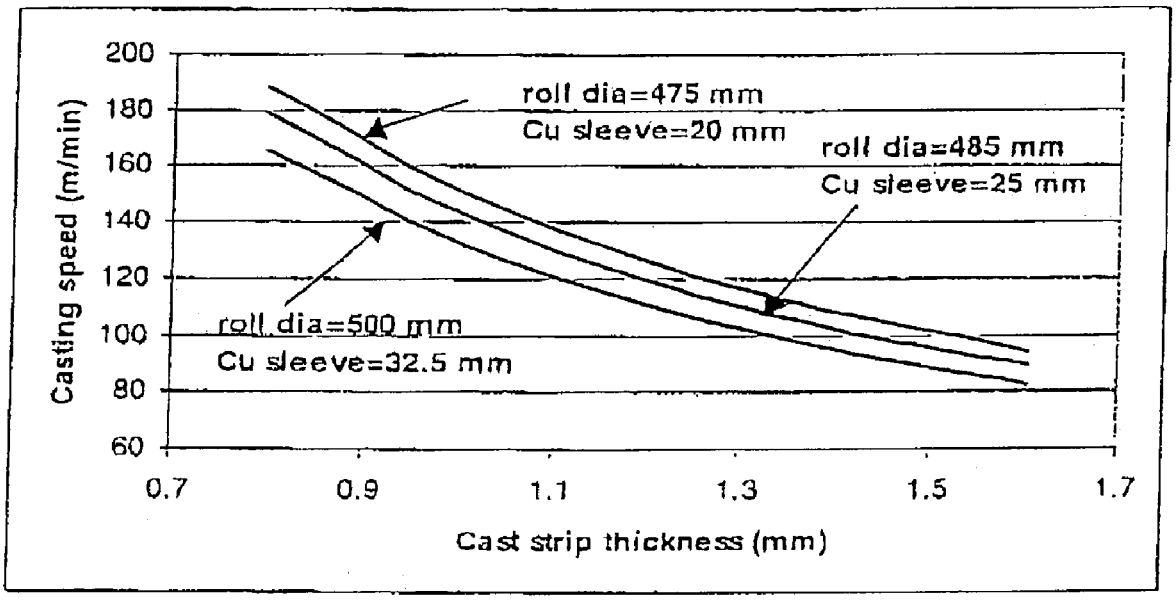
FIG. 3 is a graph showing typical maximum permitted casting speeds for casting rolls for differing strip thicknesses.

Each casting roll 74 may be formed with an outer or copper alloy sleeve defining the casting surfaces 74A. The casting surfaces 74A are machined with an initial crown to allow for thermal expansion when the rolls are in use, and a different crown as required according to the casting speed. Maximum casting speed and in turn throughput from the twin roll caster is governed by the maximum temperature which can be permitted at the casting surfaces, generally of the order of about 350° C. to 400° C. It has been found that 385° C. is a desirable operating temperature within this range. This operating temperature depends on the characteristics of casting roll 74, and primarily the roll diameter and the thickness of the copper sleeve. FIG. 3 is a graph showing typical maximum permitted casting speeds for varying cast strip thicknesses for casting rolls of various diameters and sleeve thicknesses.

In accordance with the present invention, the as-cast thickness of the strip can be controlled by changing the depth of the casting pool. The caster continues to operate at a substantially constant throughput at or close to the maximum achievable temperature with the particular casting rolls without causing over heating of the casting surfaces. The resulting flexibility in varying the as-cast thickness allows operation of the in-line rolling mill to achieve a thickness reduction necessary to improve strip surface quality and final shape of the strip. Generally a reduction in the range 5% to 30% will be sufficient. A standard reduction within this range may be defined as the default and thereafter assumed to be the desired reduction when processing customer orders. For example, a reduction of the order of 15% will be appropriate and could be defined as the standard reduction. Of course, customers could choose a reduction other than any such standard reduction, and may even desire a reduction outside the general range.

A typical methodology for processing customer orders and operating the strip casting line accordingly is as follows:

1. Customer provides product thickness requirement.
2. Calculate cast thickness=customer thickness+15%. This is required to produce after casting a superior strip surface via rolling mill +rollbite lubrication.
3. Calculate rolling mill force set point to achieve targeted final thickness from cast thickness.
4. For the calculated cast thickness, determine the casting speed (which is driven by the maximum machine throughput which can still satisfy the maximum allowable roll surface temperature for a given casting roll diameter) (see FIG. 3). This gives a target casting speed for the casting roll speed controller.
5. Having determined the target casting speed, the target pool level is determined using equation 1 (Eq. 1) below. This gives the target pool level for the pool level controller:

$$R^*\mathrm{Sin}^{-1}(h/R)=u^*d^2/(k^2) \qquad \text{(Eq. 1)}$$

where, h=pool level (mm),

R=casting roll radius (mm), d=half strip thickness (mm).

k=roll k-factor ($mm/min^{0.5}$), u=casting speed (mm/min).

It will be appreciated that this methodology also allows, among other things:

1. Expanded range of cast strip thicknesses that can be produced using a single machined crown and roll texture in the casting rolls. This in turn reduces the number of casting roll sets required to produce a given product mix, thereby reducing working capital.
2. Production of thin (cold roll replacement) strip with acceptable shape while at the same time preserving the cast microstructure, and, in turn, enabling the production of a large range of mechanical properties from a molten steel composition of a given chemistry specification.
3. Constant(typically near maximum allowable) caster throughput for different cast strip thicknesses without over heating the casting rolls.
4. Change of thicknesses on a coil within a particular sequence, thus reducing the lead times to fulfil customer orders.

To illustrate, if a customer orders 1.0 mm thick strip, the strip caster would be operated to produce an as-cast thickness of say 1.15 mm, and the rolling mill would be operated to reduce the thickness to 1.0 mm and improve strip surface quality. From FIG. 3, the target casting speed would be about 110 m/mm for a 500 mm diameter roll. This determination is influenced by the maximum temperature that the casting rolls can tolerate for a reasonable operating life, which is generally of the order of about 350° C. to 400° C. If the thickness of the copper sleeve of the roll is reduced, the target speed (to achieve the same maximum copper surface temperature) may be higher. For a target speed of 110 m/mm and a typical roll k-factor of 16.25 (which can vary with the texture of the casting surface), equation No. 1 can be used to determine a target pool height of 130 mm, which becomes the target pool level control for this particular customer order.

Figure 4:
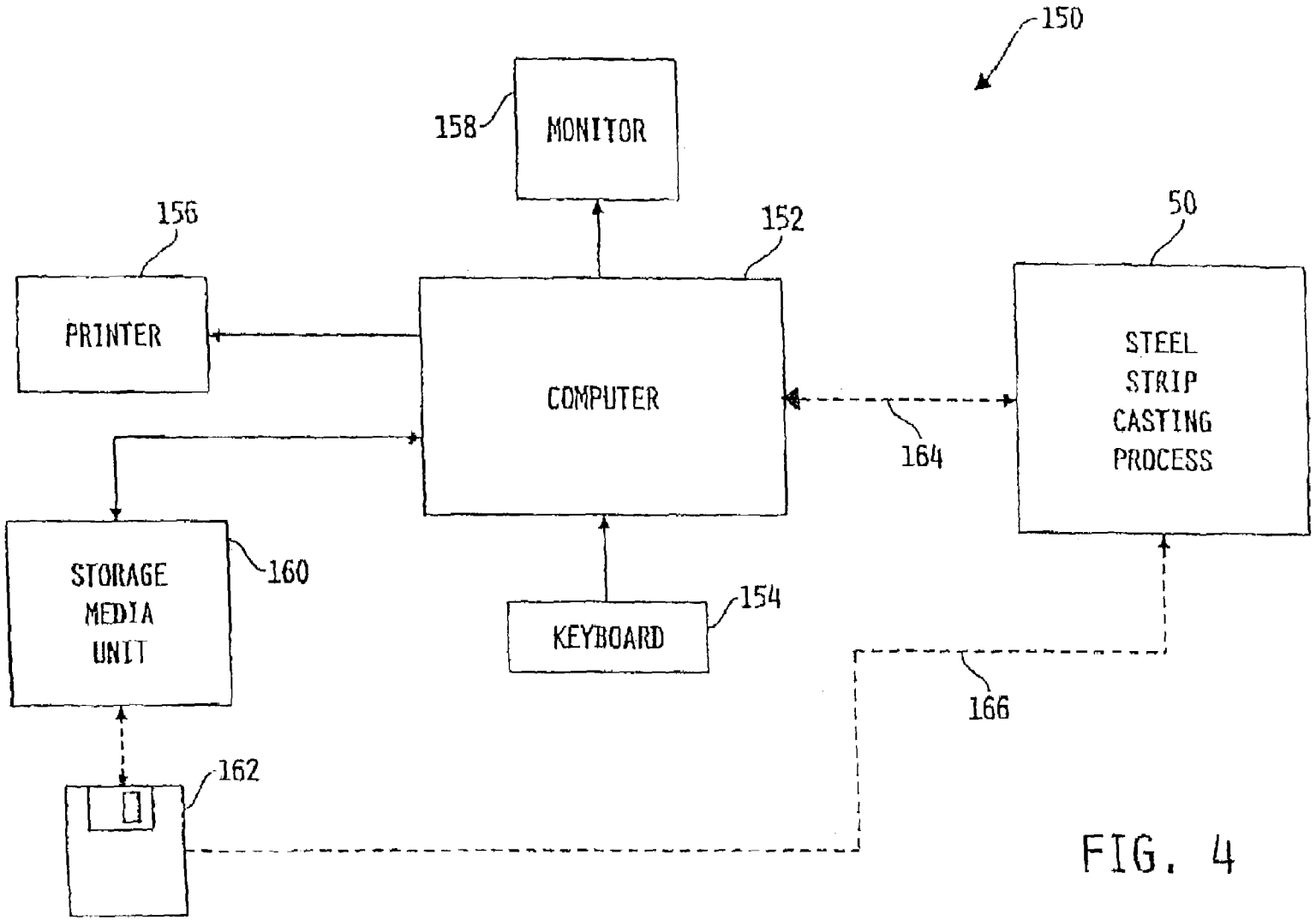
FIG. 4 diagrammatically illustrates a computer system into which details of customer orders can be entered and processed to determine casting speed targets and casting pool depth targets for controlling the casting process, as well as controlling other process parameters to meet customer requirements.

In accordance with the present invention, customer orders for steel strip may be entered into a general purpose computer system, such as computer system 150 of FIG. 4, and processed to determine the casting speed and pre-depth targets as described above.

Referring to FIG. 4, general purpose computer system 150 includes a general purpose computer 152 that may be a conventional desktop personal computer (PC), or a laptop or notebook or handheld computer, or other general purposed computer or combination of computers configured to operate in a manner to be described subsequently. For example, computer system 150 may comprise a local-area or wide-area network of computers 152. Computer system 150 further comprises various input and output devices.

Such input devices allow for entering information relating to the customer's order and may include a conventional keyboard 154 electrically connected to computer 152. Such input information may also be entered via input devices such as a bar-code scanner, an optical-character-recognition scanner, a voice recognition device, a character-recognition pad, another computer or computer system, or other suitable input device. Customer parameters also may be inputted and controlled directly from a remote input device via, for example, an internet, a modem, or other suitable connection. Input information may also be retrieved from a connected storage device 160, which may be a disk drive for use with a floppy disk 162, or a CD or DVD drive, or other suitable storage media unit.

Such a storage device 160 may also be an output device. Thus, computer 152 is electrically connected to storage media unit 160, wherein computer 152 is configured to store information to, and retrieve information from, storage unit 160.

The computer system 150 may also include any one or combination of other suitable output devices, such as a printer, a visual display device such as a monitor, another computer or system of computers, or one or more process controllers. For example, computer 152 may be electrically connected to a printer 156, wherein computer 152 may be configured to print a set of process parameters in the form of a process change report or similar report, wherein the process change report sets forth the targets for controlling the casting speed and casting pool depth.

Computer 152 also may be electrically connected to a conventional monitor 158, wherein computer 152 may be configured to display a set of process parameters in the form of a process change report or similar report, wherein the process change report sets forth the process parameters and/or targets for controlling the continuous steel strip casting process. An operator of the continuous steel strip casting process may view the process change report displayed on the monitor 158, in addition to or in place of a printed report, and may make corresponding physical changes to the continuous steel strip casting process to thereby produce the customer-ordered steel strip product.

Computer system 150 may also directly control the strip casting process 50. For example, two-way connection 164 illustratively connects computer 152 directly to the various controllers described herein. The computer 152 may thereby directly make corresponding physical changes to the continuous steel strip casting process to thereby produce the customer-ordered steel strip product. In addition, the computer 152 may monitor and receive feedback from the process 50 via signals over connection 164 and may make adjustments accordingly, or allow the operator to make adjustments.

One skilled in the art will recognize that the depicted and described connections between the various components of the computer system 150 may be hard-wire connections, radio frequency connections, and/or infrared or other optical or electromagnetic connections or any combination thereof.

Computer system 150 may also be operated to produce and/or control other process parameters, targets, and/or set points for controlling the continuous steel strip casting process in accordance with customer orders as is more fully disclosed in U.S. Patent Application Ser. No. 60/236390. Such parameters may, for example, be used to control operation of the water sprays 66 to control cooling of the strip in order to meet customer-specified yield strength requirements.

While the invention has been illustrated and described in detail with reference of the drawings and foregoing description, the same is to be considered as illustrative and not restrictive in character, it being understood that one skilled in the art will recognize, and that it is the applicants desire to protect, all aspects, changes and modifications that come within the spirit of the invention.

What is claimed is:

1. A method of casting cast steel strip from a casting pool of molten steel using the casting surfaces of a twin roll caster to produce strip of differing thicknesses in the as-cast condition, comprising:

(a) determining for each desired thicknesses of the as-cast strip, a target casting speed related to a temperature which avoids over-heating of the casting roll surfaces to extend casting roll life;

(b) determining from each target casting speed a target casting pool depth to produce a cast strip of the desired thickness when the twin roll caster is operated at the target casting speed; and (c) operating the caster to cast strip based on the determined target casting speed and the determined target depth to produce cast strip generally of the desired thickness.

2. The method as described in claim 1 where the thickness of the as-cast strip is changed by changing the casting speed and casting pool depth without changing a casting roll.

3. The method as described in claim 1 where the thickness of the as-cast strip is changed by changing the casting pool depth without changing a casting speed or casting rolls.

4. The method as described in claim 1 comprising the additional step of:

(d) in-line rolling the strip delivered from the caster to reduce the thickness of the strip to a customer-specified thickness and provide desired surface properties to the strip.

5. The method as described in claim 1 comprising the addition step of:

(e) controlling the cooling rate of the strip to determine the microstructure of the cast strip.

6. The method as described in claim 1 where the target pool depth is determined from the target casting speed in accordance with the following equation:

$$R*\sin^{-1}(h/R)=u*d^2/k^2$$

where, h=pool depth (mm),

R casting roll radius (mm), d=half strip thickness (mm).

k=roll k-factor ($mm/min^{0.5}$), u casting speed (mm/min)

where, $k=d'/\sqrt{t}$ where, d' is the half strip thickness, and t is time.

* * * * *